US010087057B2

(12) United States Patent
Kawai et al.

(10) Patent No.: US 10,087,057 B2
(45) Date of Patent: Oct. 2, 2018

(54) BRAKING APPARATUS FOR ELECTRIC WINCH

(71) Applicants: Kobe Steel, Ltd., Kobe-shi (JP); KOBELCO CONSTRUCTION MACHINERY CO., LTD., Hiroshima-shi (JP)

(72) Inventors: Hiroaki Kawai, Kobe (JP); Takashi Hiekata, Kobe (JP); Shintaro Sasai, Hyogo (JP); Toshiro Yamashita, Hyogo (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 226 days.

(21) Appl. No.: 15/239,913

(22) Filed: Aug. 18, 2016

(65) Prior Publication Data

US 2017/0066634 A1 Mar. 9, 2017

(30) Foreign Application Priority Data

Sep. 4, 2015 (JP) ..... 2015-174607

(51) Int. Cl.
*B66D 1/48* (2006.01)
*B66D 1/02* (2006.01)
(Continued)

(52) U.S. Cl.
CPC ..... *B66D 5/02* (2013.01); *B66D 1/12* (2013.01); *B66D 1/485* (2013.01); *B66D 1/54* (2013.01)

(58) Field of Classification Search
CPC . B66D 1/12; B66D 1/485; B66D 1/54; B66D 5/02; B66C 13/28
See application file for complete search history.

(56) References Cited

U.S. PATENT DOCUMENTS 6,029,951 A * 2/2000 Guggari ..... B66D 1/485 173/11
6,851,207 B2 * 2/2005 Yoshimatsu ..... E02F 9/2075 37/348

(Continued)

FOREIGN PATENT DOCUMENTS

JP 2001-206673 7/2001
JP 2012-121675 6/2012

*Primary Examiner* — Michael E Gallion
(74) *Attorney, Agent, or Firm* — Oblon, McClelland, Maier & Neustadt, L.L.P.

(57) ABSTRACT

Provided is a braking apparatus for braking of an electric winch of a construction machine, ensuring safe braking with much regeneration. The apparatus includes a regenerative-power generation unit, a regenerative-power receiving unit, a braking device for mechanical braking separately from the regenerative-power generation unit, and a braking control unit including a necessary-braking-capacity calculation section, a regeneration-capacity calculation section calculating a regeneration capacity, and a command section. The command section, when the regeneration capacity is not less than a necessary braking capacity, performs braking with only a regenerative action while not operating the braking device and, when the regeneration capacity is less than the necessary braking capacity, calculates an auxiliary braking force equivalent to a difference between the necessary braking capacity and the regeneration capacity and brings the braking device into braking action with the auxiliary braking force.

12 Claims, 6 Drawing Sheets

(51) Int. Cl.

| | |
|---|---|
| ***B66D 5/02*** | (2006.01) |
| ***B66D 1/12*** | (2006.01) |
| ***B66D 1/54*** | (2006.01) |

(56) References Cited

U.S. PATENT DOCUMENTS

| | | | | |
|---|---|---|---|---|
| 7,659,677 | B2 * | 2/2010 | Yoshimatsu | E02F 9/121 318/362 |
| 8,881,519 | B2 * | 11/2014 | Kanninnura; Yusuke | E02F 9/123 60/414 |
| 2016/0289054 | A1 * | 10/2016 | Hiekata | B66D 1/46 |
| 2017/0043983 | A1 * | 2/2017 | Hiekata | B66C 13/12 |
| 2017/0210606 | A1 * | 7/2017 | Kawai | B60T 8/17 |

* cited by examiner

BRAKING APPARATUS FOR ELECTRIC WINCH

TECHNICAL FIELD

The present invention relates to an apparatus that brakes, while performing a regenerative action, an electric winch used in a construction machine such as a crane.

BACKGROUND ART

In recent years, it has been examined to use an electric winch driven by an electric motor as a winch mounted on a crane or the like to perform lifting work. The use of the electric winch has an advantage of ability to perform a regenerative action, that is, an operation for converting kinetic energy generated by a drop of a target object during lowering of the target object (rotation energy of the electric motor) into electric energy and collecting the electric energy.

For example, Japanese Unexamined Patent Publication No. 2012-121675 discloses using an electric generator having a power generation function as an electric motor for driving an electric winch mounted on a mobile crane and performing a control for causing the electric generator to perform a braking action for the electric winch and to output regenerative power.

It is required of such a construction machine including an electric winch to generate regenerative power as much as possible for improvement of operation efficiency while applying a proper braking force (a braking force sufficient for realizing a predetermined braking action) to the electric winch for high safety. Japanese Unexamined Patent Publication No. 2012-121675, although disclosing braking and regeneration by use of an electric generator, indicates no suggestion about control for simultaneously satisfying the above two different demands.

SUMMARY OF INVENTION

An object of the present invention is to provide an apparatus for braking an electric winch provided in a construction machine and driven to move a load, the apparatus being capable of brake the electric winch safely and surely with a sufficient braking force while generating regenerative power as much as possible. The apparatus includes: a regenerative-power generation unit that performs a regenerative action of generating regenerative power while applying a braking force to the electric winch; a regenerative-power receiving unit that receives the regenerative power generated by the regenerative-power generation unit; a braking device that applies a mechanical braking force to the electric winch separately from the braking force applied to the electric winch from the regenerative-power generation unit, the mechanical braking force being adjustable; and a braking control unit that provides commands to the regenerative-power generation unit and the braking device to thereby control braking of the electric winch. The braking control unit includes: a necessary-braking-capacity calculation section that calculates, on the basis of an operation state of the electric winch, a braking capacity necessary for achieving a required braking action on the electric winch; a regeneration-capacity calculation section that calculates a regeneration capacity that is a limit of a regenerative action performed by the regenerative-power generation unit and the regenerative-power receiving unit; and a command section that commands the regenerative-power generation unit and the braking device on the basis of the regeneration capacity calculated by the regeneration-capacity calculation section and the necessary braking capacity calculated by the necessary-braking-capacity calculation section. The command section, when the regeneration capacity is equal to or greater than the necessary braking capacity, commands the regenerative-power generation unit to perform the braking of the electric winch with only a regenerative action by the regenerative-power generation unit while not operating the braking device. The command section, when the regeneration capacity is less than the necessary braking capacity, commands the regenerative-power generation unit to perform the regenerative action within a range of the regeneration capacity, calculates an auxiliary braking force equivalent to a difference between the necessary braking capacity and the regeneration capacity, and commands the braking device to perform the braking of the electric winch with the auxiliary braking force.

DESCRIPTION OF EMBODIMENTS

A preferred embodiment of the present invention is explained with reference to the drawings.

Figure 1:
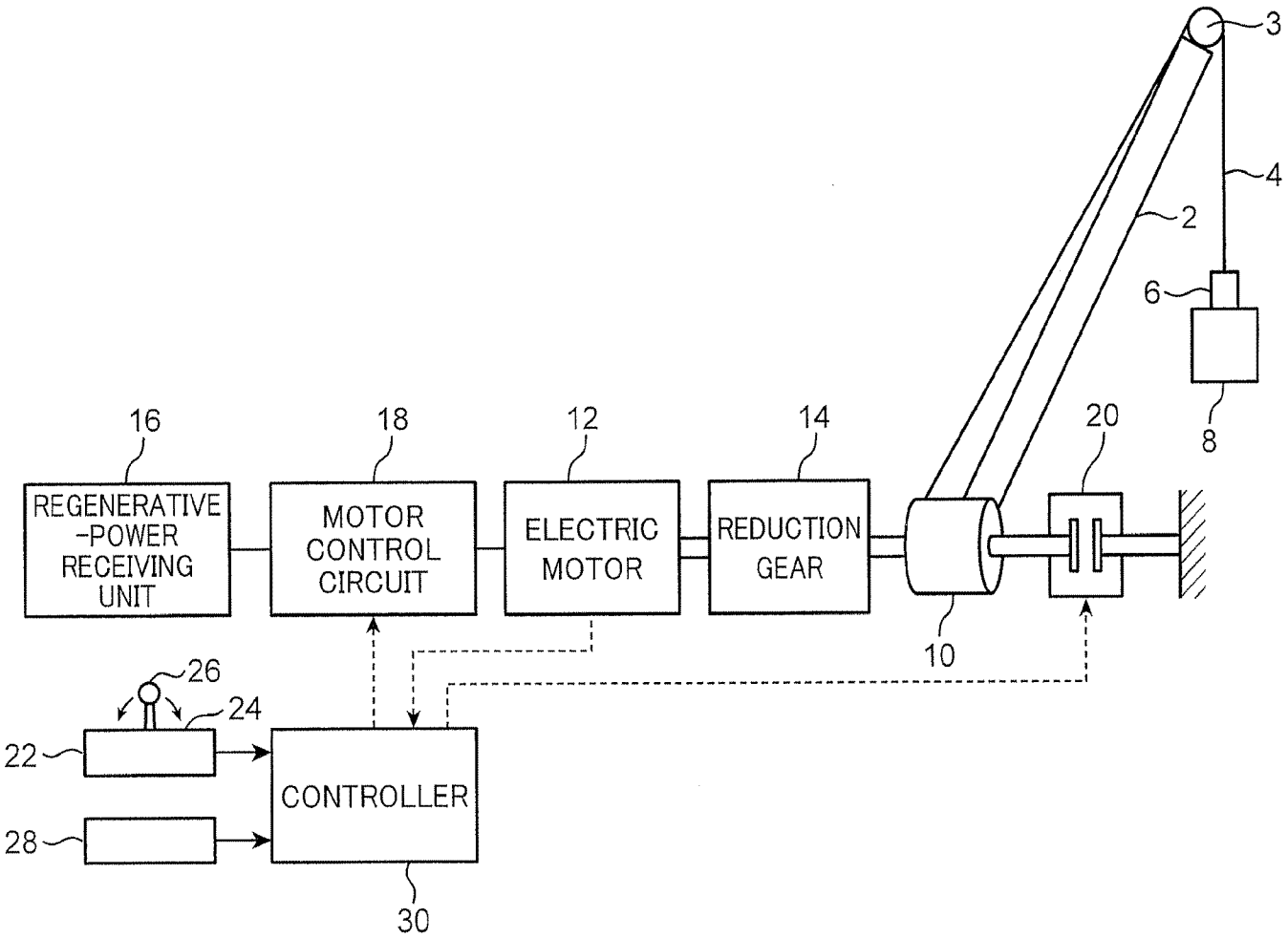
FIG. 1 is a schematic diagram showing an electric winch mounted on a crane and a braking apparatus for the electric winch according to an embodiment of the present invention.

FIG. 1 shows a main part of a winch braking apparatus that controls driving of a crane, which is a construction machine according to this embodiment, and an electric winch mounted on the crane. The crane includes a boom 2 capable of rising and falling and a rope 4 for lifting. The electric winch includes a winch drum 10 rotatable around a horizontal axis. The rope 4 has a first portion including one end of the rope 4, the first portion being wound on the winch drum 10, and a second portion including the other end thereof, the second portion being suspended from a sheave 3 at the distal end of the boom 2. To the other end of the rope 4 is connected a hook device 6, with which a suspended load 8 is engaged.

The winch drum 10 is connected with a driving apparatus that rotationally drives the winch drum 10 and a braking apparatus that brakes the winch drum 10. The driving apparatus includes an electric motor 12 and a reduction unit 14. The braking apparatus includes the electric motor 12, a motor control circuit 18, a regenerative-power receiving unit 16, a braking device 20, an operation device 22, and a controller 30.

The electric motor 12 is capable of both of a motor action, which is an original action, and a regenerative action, which is a generator action. The motor action is an action of rotating the winch drum 10 by applying torque to the winch drum 10 via the reduction unit 14. The regenerative action is an action of rotating in the direction same as the direction of the winch drum 10 by receiving application of load torque from the winch drum 10 via the reduction unit 14, that is, torque applied to the winch drum 10 by a lifting load due to the suspended load 8 to thereby generate regenerative power. In the regenerative action, the electric motor 12 applies a braking force equivalent to regenerative energy to the winch drum 10.

The regenerative-power receiving unit 16 receives the regenerative power generated by the electric motor 12. The regenerative-power receiving unit 16 desirably includes an electric storage device (e.g., a battery or a capacitor) that stores the regenerative power. The following explanation is based on the precondition that the regenerative-power receiving unit 16 includes a battery. The electric storage device, storing the generated regenerative power, enables the regenerative power to be consumed at a suitable point in time when it is required. The regenerative-power receiving unit according to the present invention is, however, not limited to the regenerative-power receiving unit including the electric storage device. The regenerative-power receiving unit may be configured to consume received regenerative power on the spot (that is, to convert the regenerative power into other energy such as kinetic energy or thermal energy), such as a regenerative electric motor rotated by the regenerative power, an air conditioner, or other electric equipment.

The motor control circuit 18 constitutes a regenerative-power generation unit in conjunction with the electric motor 12. Specifically, the motor control circuit 18 includes an inverter and performs control of the motor action and the generator action made by the electric motor 12. The electric motor 12 is switched between a first state of performing the motor action and a second state of performing the regenerative action (the generator action), according to an input of a signal from the motor control circuit 18. Besides, the motor control circuit 18 also performs an action of supplying generative power generated by the regenerative action of the electric motor 12 to the regenerative-power receiving unit 16.

The braking device 20 applies a mechanical braking force to the winch drum 10 separately from a braking force applied to the winch drum 10 from the electric motor 12 performing the regenerative action. The braking force is adjustable in accordance with an electric signal (a braking command) input to the braking device 20 from the outside.

The operation device 22 includes a device main body 24 and an operation lever 26, which is an operation member. The operation lever 26 receives operation by an operator for designating target speed of the electric winch. The device main body 24 inputs an electric signal corresponding to an operation amount θL applied to the operation lever 26, namely, a command of the target speed, to the controller 30.

The crane includes an overload protection device 28. The overload protection device 28 inputs, into the controller 30, (a signal of) a lifting load FL applied to the winch drum 10 by the suspended load 8.

Figure 2:
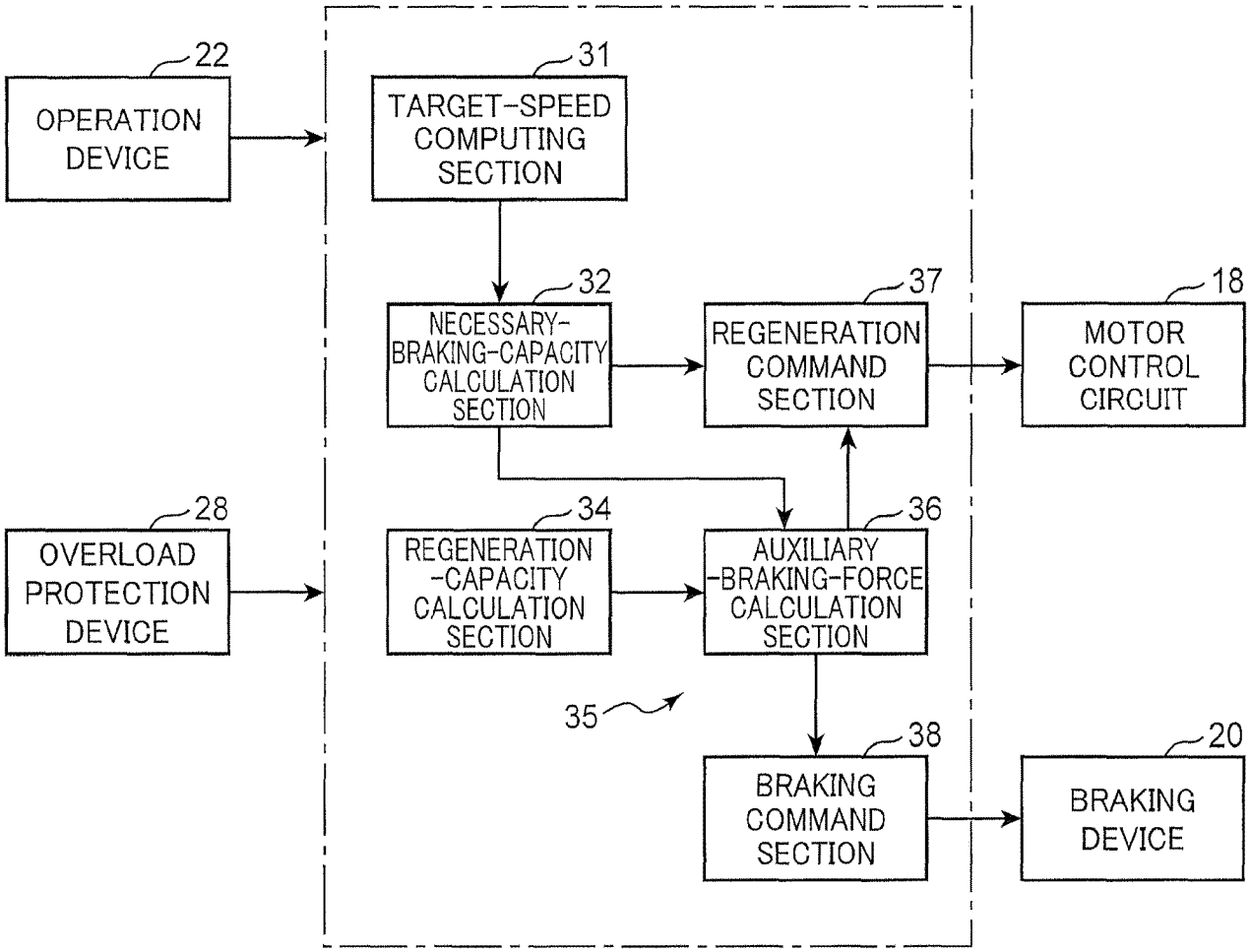
FIG. 2 is a block diagram showing a functional configuration of a controller included in the braking apparatus.

The controller 30 constitutes a braking control unit that receives the inputs to control braking of the electric winch. As shown in FIG. 2, the controller 30 includes a target-speed computing section 31, a necessary-braking-capacity calculation section 32, a regeneration-capacity calculation section 34, and a command section 35, the command section 35 including an auxiliary-braking-force calculation section 36, a regeneration command section 37, and a braking command section 38.

The target-speed computing section 31 computes a target speed (specifically, target angular velocity) ωref corresponding to the operation amount θL, that is, the target speed designated by the operator, on the basis of an electric signal input from the operation device 22, that is, a signal related to the operation amount θL of the operation lever 26.

The necessary-braking-capacity calculation section 32 calculates a braking capacity necessary for achieving a required braking action on the electric winch, on the basis of the operation state of the electric winch.

The regeneration-capacity calculation section 34 calculates a regeneration capacity, which is a limit of a regenerative action including a regenerative-power generating action performed by the electric motor 12 and the motor control circuit 18 and a regenerative-power receiving action performed by the regenerative-power receiving unit 16. The regenerative-power receiving unit 16 according to this embodiment computes both of an allowable regenerative energy and an allowable regenerative power as the regeneration capacity. For the calculation of these allowable values, the regeneration-capacity calculation section 34 calculates a regenerative-power generation capacity of the regenerative-power generation unit (specifically, respective allowable values of the regenerative power and the regenerative energy generated by the electric motor 12) and a regenerative-power receiving capacity of the regenerative-power receiving unit 16 (specifically, respective allowable values of the regenerative power and the regenerative energy input to the battery), and determines the regeneration capacity on the basis of selection of the lower capacity between the regenerative-power generation capacity and the regenerative-power receiving capacity.

The auxiliary-braking-force calculation section 36 of the command section 35 calculates an auxiliary braking force Fbr on the basis of comparison of the necessary braking capacity calculated by the necessary-braking-capacity calculation section 32 and the regeneration capacity calculated by the regeneration-capacity calculation section 34. On the basis of the result of the calculation, the regeneration command section 37 provides a regeneration command to the motor control circuit 18 and the braking command section 38 provides a braking command to the braking device 20.

Specifically, when the regeneration capacity is equal to or greater than the necessary braking capacity, the auxiliary-braking-force calculation section 36 sets the auxiliary braking force Fbr to 0. Upon this, the braking command section 38 provides no braking command to the braking device 20 and only the regeneration command section 37 provides a regeneration command to the motor control circuit 18. Therefore, at this point, the braking of the electric winch is performed by only the regenerative action by the electric motor 12. On the other hand, when the regeneration capacity is less than the necessary braking capacity, the auxiliary-braking-force calculation section 36 computes the auxiliary braking force Fbr corresponding to the difference between the capacities. The regeneration command section 37 produces an output of a regeneration command so as to bring the regenerative-power generation unit into the regenerative action within a range of the regeneration capacity (i.e., so as to make full use of the regeneration capacity), while the braking command section 38 provides a braking command to the braking device 20 to perform mechanical braking of the electric winch with the auxiliary braking force Fbr.

Figure 3:
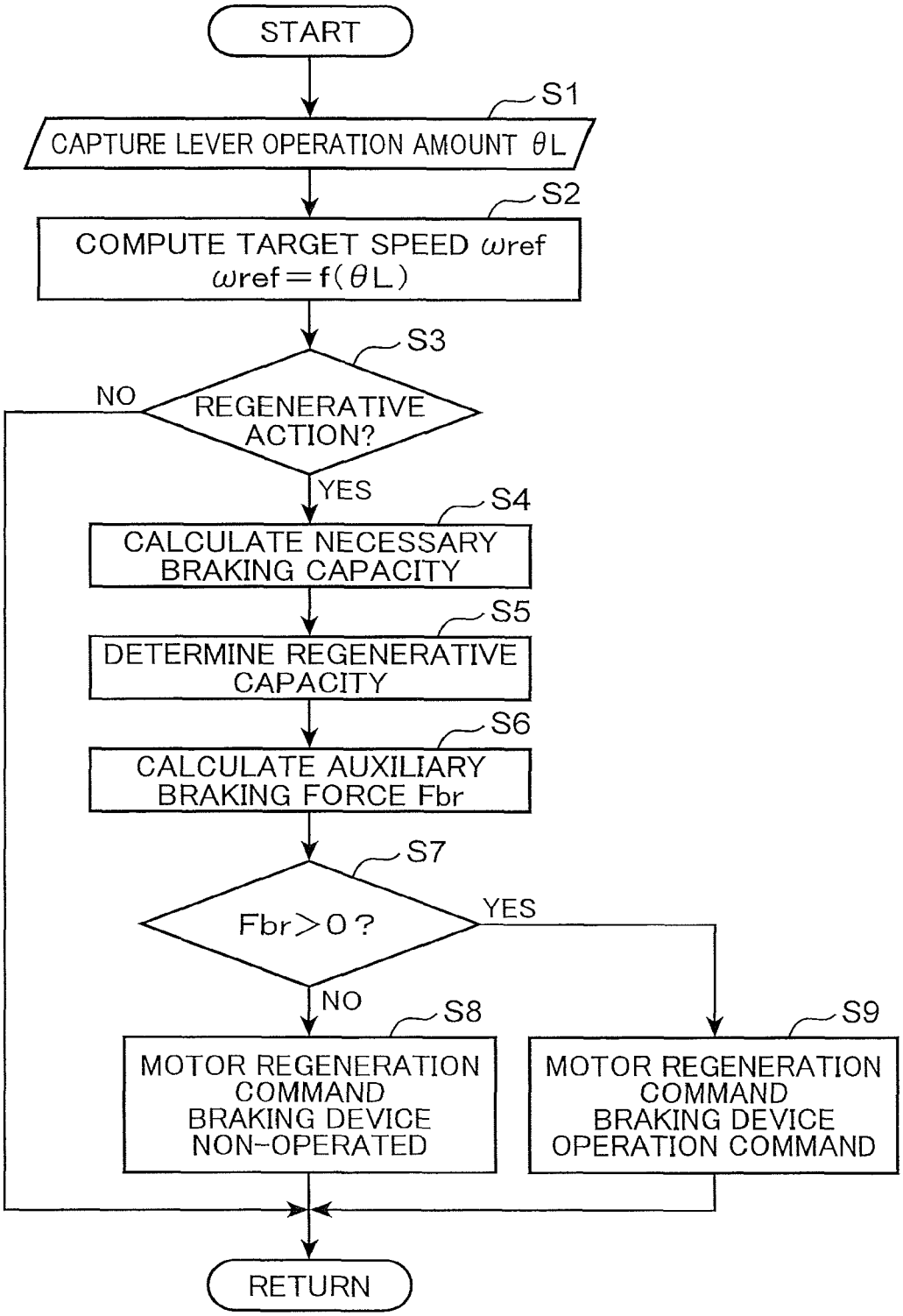
FIG. 3 is a flowchart for explaining an arithmetic control operation performed by the controller.
Figure 4:
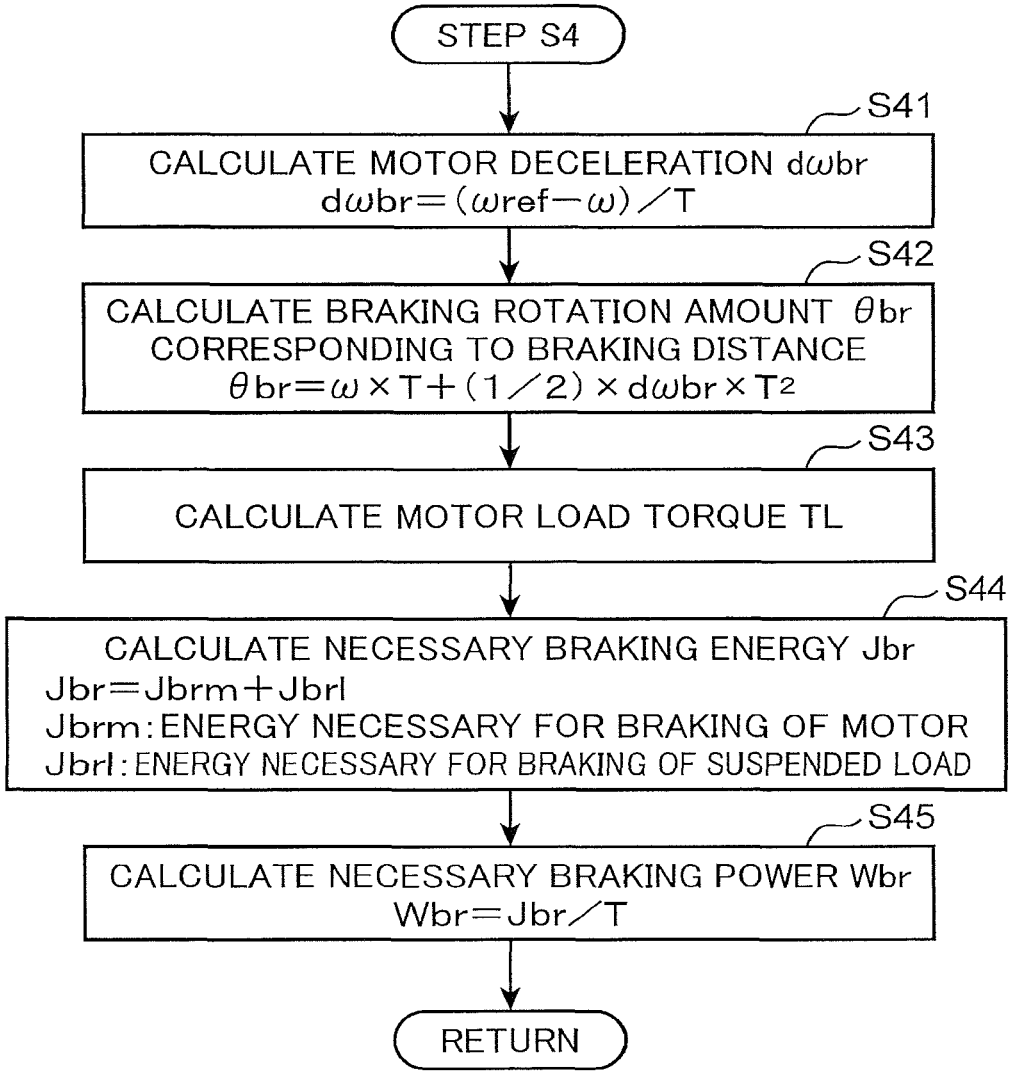
FIG. 4 is a flowchart for explaining details of a necessary-braking-capacity calculating operation included in the arithmetic control operation shown in FIG. 3.
Figure 5:
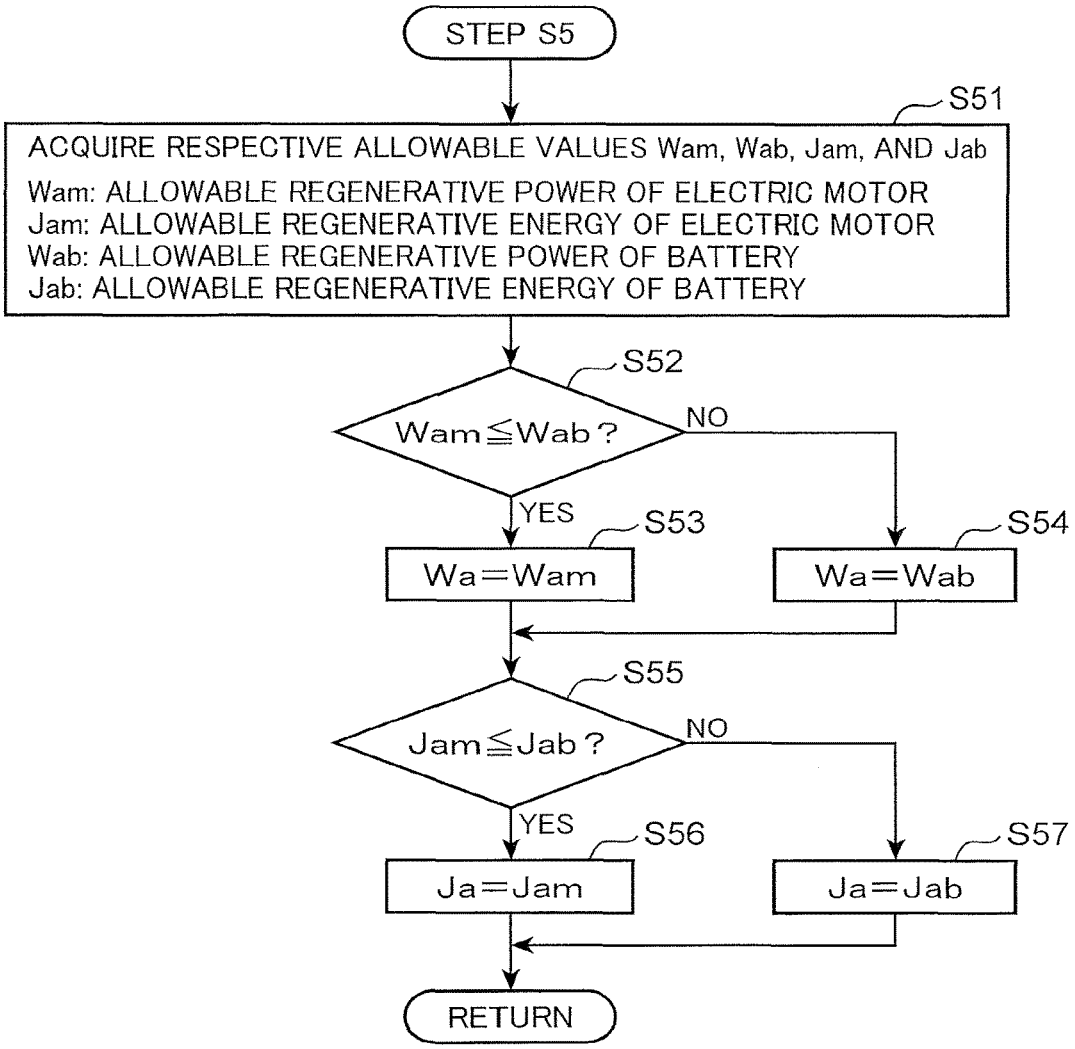
FIG. 5 is a flowchart for explaining details of a regenerative-power calculating operation included in the arithmetic control operation shown in FIG. 3.
Figure 6:
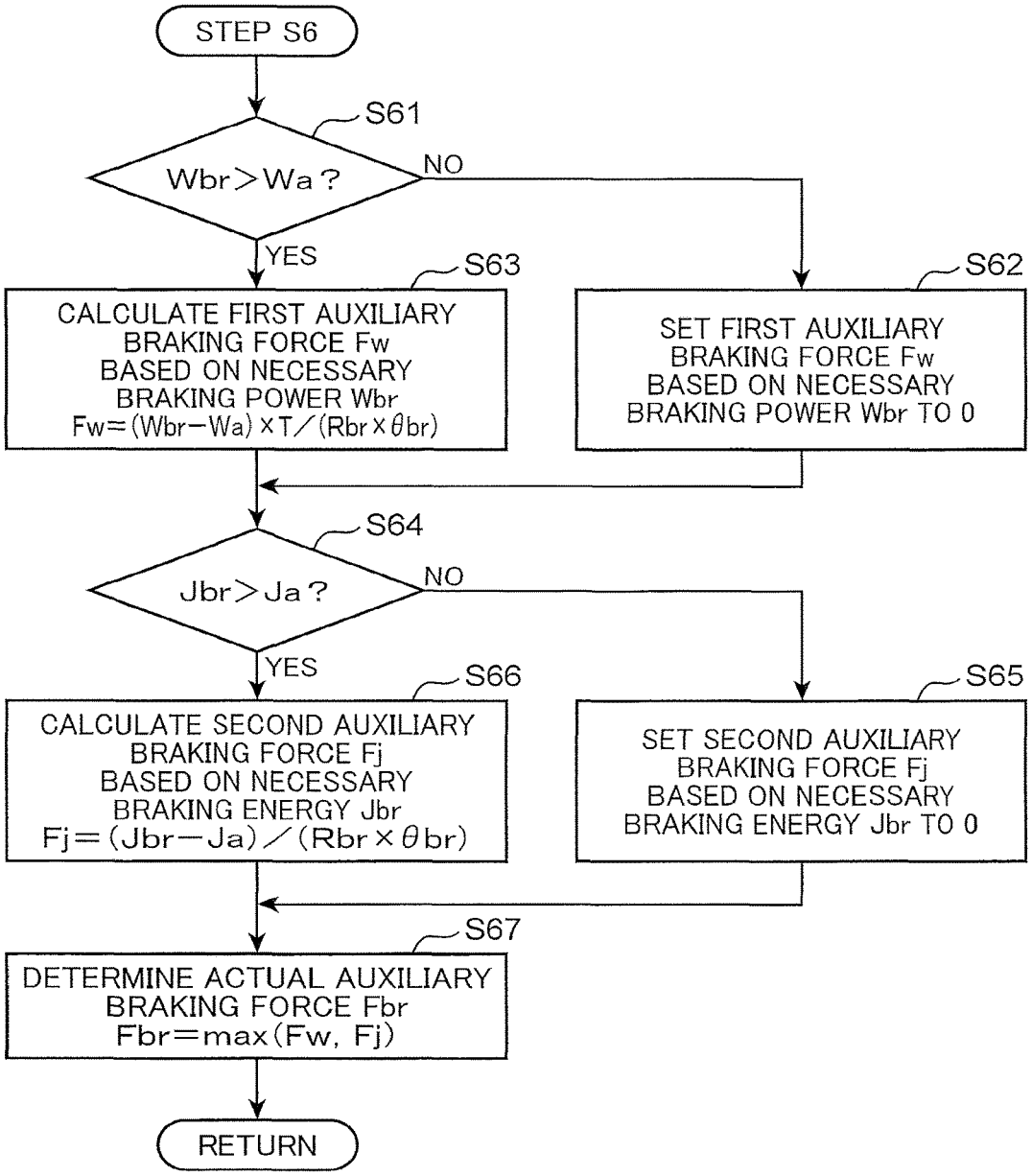
FIG. 6 is a flowchart for explaining details of an auxiliary-braking-force calculating operation included in the arithmetic control operation shown in FIG. 3.

Next will be explained a specific arithmetic control operation performed by the controller 30 with reference to a flowchart of FIG. 3 showing a main routine of the arithmetic control operation and flowcharts of FIGS. 4 to 6 showing sub-routines of the arithmetic control operation. The flowchart of FIG. 3 shows an operation performed in one cycle of a computation cycle. Therefore, the operation shown in the flowchart is repeated at every computation cycle.

1) Computation of the Target Speed ωref (Steps S1 and S2 in FIG. 3)

The target-speed computing section 31 of the controller 30 captures information on the operation amount θL on the operation lever 26 on the basis of an electric signal input from the operation device 22 (step S1) and computes the target speed ωref corresponding to the operation amount θL (step S2). The target speed ωref is given by, for example, a function f (θL) of the operation amount θL. Specific computation of the target speed ωref may be performed on the basis of an operational expression given in advance or by use of a map or a table stored in the controller 30. The controller 30 captures the information on the operation amount θL at every moment and updates the target speed ωref on a real time basis, which enables the controller 30 to execute desirable braking control in consideration with the will of the operator applying an operation to the operation lever 26.

After the computation of the target speed ωref, the controller 30 executes the following arithmetic control operation only when a regenerative action is performed (mainly when a lowering action is performed) (YES in step S3).

2) Calculation of a Necessary Braking Capacity (Step S4 in FIG. 3 and Steps S41 to S45 in FIG. 4)

The necessary-braking-capacity calculation section 32 of the controller 30 calculates a necessary braking capacity, which is a braking capacity necessary for performing a required braking action, on the basis of the target speed ωref and a lifting load FL input from the overload protection device 28 (step S4 in FIG. 3).

Specifically, the necessary-braking-capacity calculation section 32 calculates deceleration dωbr in every control cycle T required for reducing the present winch speed ω to the target speed ωref. The deceleration dωbr is given by the following Expression (1) (step S41 in FIG. 4).

$$d\omega br=(\omega ref-\omega)/T \tag{1}$$

Subsequently, the necessary-braking-capacity calculation section 32 calculates a braking rotation amount θbr of the winch drum 10 corresponding to a braking distance, on the basis of the deceleration dωbr. The braking rotation amount θbr is given by the following Expression (2) (step S42).

$$\theta br=\omega\times T+(1/2)\times d\omega br\times T2 \tag{2}$$

On the other hand, the necessary-braking-capacity calculation section 32 calculates a load torque TL applied to the winch drum 10 and the electric motor 12 coupled to the winch drum 10 due to the lifting load FL, on the basis of the lifting load FL input from the overload protection device 28 (step S43). The load torque TL is given by the following Expression (3), when the radius of the winch drum 10 is represented as Rd and a reduction ratio by the reduction unit 14 is represented as ρ.

$$TL=FL\times Rd/\rho \tag{3}$$

The necessary-braking-capacity calculation section 32 performs: calculating an energy Jbrm necessary for braking of the electric motor 12, on the basis of the target speed ωref, the load torque TL, and the braking rotation amount θbr; calculating an energy Jbrl necessary for braking of the suspended load 8, on the basis of the load torque TL and a braking distance Δy (=θbr×Rd) of the suspended load 8; and calculating the sum of both the kinds of energy (=Jbrm+Jbrl) as necessary braking energy Jbr (step S44). Both the kinds of energy Jbrm and Jbrl are respectively given by the following Expressions (4a) and (4b).

$$Jbrm=(1/2)\times Im\times(\omega ref2-\omega 2)+TL\times\theta br \tag{4a}$$

$$Jbrl=(1/2)\times(FL/g)\times(vref2-v2)+FL\times\Delta y \tag{4b}$$

Herein, Im represents an inertial moment of the electric motor 12, g represents gravitational acceleration, and vref and v represent moving speeds of the suspended load 8 corresponding to the target speed and actual speed (rotational angular velocity) ωref and ω of the winch drum 10, respectively.

Furthermore, the necessary-braking-capacity calculation section 32 calculates a value obtained by dividing the necessary braking energy Jbr by the control cycle T, as necessary braking power Wbr (step S45).

3) Calculation of Regeneration Capacity (Step S5 in FIG. 3 and Steps S51 to S57 in FIG. 5)

Subsequently, the regeneration-capacity calculation section 34 of the controller 30 calculates a regeneration capacity, specifically, an allowable regenerative power Wa and an allowable regenerative energy Ja, on the basis of the regenerative-power generation capacity of the regenerative-power generation unit constituted by the electric motor 12 and the motor control circuit 18 (specifically, a generation capacity of regenerative power of the electric motor 12) and the regenerative-power receiving capacity of the regenerative-power receiving unit 16 (specifically, a receiving capacity of regenerative power of the battery), respectively (step S5).

First, the regeneration-capacity calculation section 34 acquires, through computation or the like, respective allowable values Wam and Jam of the regenerative power and the regenerative energy of the electric motor 12 and respective allowable values Wab and Jab of the regenerative power and the regenerative energy of the battery (step S51). The allowable value of the regenerative power of the electric motor 12, namely, the allowable regenerative power Wam, is an upper limit of regenerative power that can be normally generated by the electric motor 12, being able to be determined on the basis of, for example, rated values (a rated current and a rated voltage) of the electric motor 12. The allowable value of the regenerative energy of the electric motor 12, namely, the allowable regenerative energy Jam, can be calculated by, for example, multiplying the allowable regenerative power Wam with a braking time. The allowable values Wab and Jab of the regenerative power and the regenerative energy of the battery are respective upper limit values of the electric power and the energy that can be received by the battery, that is, respective upper limit values of electric power and energy for charging the battery. The allowable values Wab and Jab can be calculated from a charging state (e.g., SOC) of the battery. The controller 30 is enabled to calculate the upper limit values Wab and Jab during a braking action by, for example, storing a map or a table prepared concerning a relation between the charging state and the upper limit values Wab and Jab.

Subsequently, the regeneration-capacity calculation section 34 calculates respective allowable values Wa and Ja of regenerative power and regenerative energy as the regeneration capacity, on the basis of the allowable values described above. Specifically, the regeneration-capacity calculation section 34 compares the allowable regenerative power Wam of the electric motor 12 and the allowable regenerative power Wab of the battery and selects the lower one as the allowable regenerative power Wa (steps S52 to S54). Similarly, the regeneration-capacity calculation section 34 compares the allowable the regenerative energy Jam of the electric motor 12 and the allowable regenerative energy Jab of the battery and selects the lower one as the allowable regenerative energy Ja (steps S55 to S57).

4) Calculation of the Auxiliary Braking Force Fbr (step S6 in FIG. 3 and Steps S61 to S67 in FIG. 6)

The auxiliary-braking-force calculation section 36 of the controller 30 calculates the auxiliary braking force Fbr on the basis of comparison of the necessary braking capacity calculated in step S4 and the regeneration capacity calculated in step S5 (step S6 in FIG. 3). The auxiliary braking force Fbr is a supplemental force for the case where the regeneration capacity is less than the necessary braking capacity, being a mechanical braking force applied to the winch drum 10 by the braking device 20.

The auxiliary-braking-force calculation section 36 according to this embodiment performs: calculating a first auxiliary braking force Fw on the basis of comparison of the necessary braking power Wbr and the allowable regenerative power Wa; calculating a second auxiliary braking force Fj on the basis of comparison of the necessary braking energy Jbr and the allowable regenerative energy Ja; and determining an actual auxiliary braking force Fbr on the basis of comparison of the first and second auxiliary braking forces Fw and Fj.

Specifically, the auxiliary-braking-force calculation section 36 compares the necessary braking power Wbr and the allowable regenerative power Wa (step S61 in FIG. 6). When the necessary braking power Wbr is equal to or less than the allowable regenerative power Wa (NO in step S61), the auxiliary-braking-force calculation section 36 sets the first auxiliary braking force Fw to 0 (step S62). When the necessary braking power Wbr is greater than the allowable regenerative power Wa (YES in step S61), the auxiliary-braking-force calculation section 36 calculates a braking force corresponding to the difference between the necessary braking power Wbr and the allowable regenerative power Wa as the first auxiliary braking force Fw (step S63). The first auxiliary braking force Fw is given by the following Expression (5) when a braking radius, that is, a radial distance between a position where an auxiliary braking force by the braking device 20 acts on the winch drum 10 and a drum rotation axis is represented as Rbr.

$$Fw=(Wbr-Wa)\times T/(Rbr\times\theta br) \quad (5)$$

Likewise, the auxiliary-braking-force calculation section 36 compares the necessary braking energy Jbr and the allowable regenerative energy Ja (step S64 in FIG. 6). When the necessary braking energy Jbr is equal to or less than the allowable regenerative energy Ja (NO in step S64), the auxiliary-braking-force calculation section 36 sets the second auxiliary braking force Fj to 0 (step S65). When the necessary braking energy Jbr is greater than the allowable regenerative energy Ja (YES in step S64), the auxiliary-braking-force calculation section 36 calculates a braking force corresponding to the difference between the necessary braking energy Jbr and the allowable regenerative energy Ja as the second auxiliary braking force Fj (step S66). The second auxiliary braking force Fj is given by the following Expression (6).

$$Fj=(Jbr-Ja)/(Rbr\times\theta br) \quad (6)$$

The auxiliary-braking-force calculation section 36 compares the first and second auxiliary braking forces Fw and Fj and selects the greater braking force as an actual auxiliary braking force Fbr (step S67). This selection of the auxiliary braking force Fbr allows calculation of the auxiliary braking force for performing the required braking action more surely.

5) Provision of a Regeneration Command and a Braking Command (Steps S7 to S9 in FIG. 3)

The command section 35 of the controller 30 determines a regeneration command and a braking command to be provided to the motor control circuit 18 and the braking device 20, respectively, on the basis of a result of the calculation by the auxiliary-braking-force calculation section 36, and outputs the regeneration command and the braking command. Specifically, when the auxiliary braking force Fbr calculated by the auxiliary-braking-force calculation section 36 is 0 (NO in step S7), that is, when the auxiliary braking force Fbr is not required, the regeneration command section 37 provides a regeneration command to the motor control circuit 18 so as to bring the electric motor 12 into regenerative action as much as the necessary braking capacity (the necessary braking power Wbr or the necessary braking energy Jbr), while the braking command section 38 provides no braking command to the braking device 20 in order to keep the braking device 20 be non-operated (step S8). In contrast, when the auxiliary braking force Fbr calculated by the auxiliary-braking-force calculation section 36 is greater than 0 (YES in step S7), that is, when the auxiliary braking force Fbr is required, the regeneration command section 37 provides a regeneration command to the motor control circuit 18 so as to bring the electric motor 12 into regenerative action with full use of the regeneration capacity (the allowable regenerative power Wa or the allowable regenerative energy Ja), while the braking command section 38 provides a braking command to the braking device 20 so as to cause the braking device 20 to apply a braking force equivalent to the auxiliary braking force Fbr to the winch drum 10 (step S9).

These provisions of the regeneration command and the braking command make it possible to brake the winch drum 10 with a proper braking force through setting of a proper auxiliary braking force Fbr, even when the necessary braking capacity is greater than the regeneration capacity, while allowing the maximum regenerative power to be generated within a range of the regeneration capacity, whether the necessary braking capacity is greater than the regeneration capacity.

The present invention is not limited to the above-described embodiment, for example, permitting the following modifications to be made.

A) Regarding Calculation of the Generation Capacity

The regeneration-capacity calculation section according to the present invention can be modified to calculate the regeneration capacity on the basis of only one of the regenerative-power generation capacity of the regenerative-power generation unit and the regenerative-power receiving capacity of the regenerative-power receiving unit. For example, when the receiving capacity of the regenerative-power receiving unit is so great that the receiving capacity does not have to be considered, the regenerative-power generation capacity (e.g., the allowable regenerative power or the allowable regenerative energy of the electric motor) can be directly set to the regeneration capacity. In contrast, when the generation capacity of the regenerative-power generation unit is so great that the generation capacity does not have to be considered, the regenerative-power receiving capacity (e.g., the allowable regenerative power or the allowable regenerative energy of the battery) can be directly set to the regeneration capacity. On the other hand, the above embodiment including the calculation of both of the regenerative-power generation capacity and the regenerative-power receiving capacity and the selection of the lower one between the capacities to calculate the regeneration capacity provides an advantage of allowing both of the regenerative-power generation unit and the regenerative-power receiving unit to be safely operated even when both of the regenerative-power generation capacity and the regenerative-power receiving capacity are restricted.

Besides, the regeneration-capacity calculation section according to the present invention can be modified to calculate only one of the allowable regenerative power and the allowable regenerative energy as the regeneration capacity. On the other hand, the above embodiment including the calculation of both of the allowable regenerative power and the allowable regenerative energy, the calculation of the first auxiliary braking force obtained by the comparison of the necessary braking capacity calculated by the necessary-braking-capacity calculation section and the allowable regenerative power and the second auxiliary braking force obtained by the comparison of the necessary braking capacity and the allowable regenerative energy, and the selection of the greater one of the first auxiliary braking force and the second auxiliary braking force as the final auxiliary braking force provides an advantage of allowing the braking force necessary for the required braking action to be more properly determined.

B) Regarding Calculation of the Necessary Braking Capacity

While the necessary-braking-capacity calculation section 32 according to the embodiment calculates load torque on the basis of the lifting load FL input from the overload protection device 28, it is also possible to estimate the lifting load FL from, for example, a torque actually output by the electric motor 12.

Besides, while the necessary-braking-capacity calculation section 32 according to the embodiment captures, on a real time basis, the target speed ωref designated by the operation device 22 and computes the motor deceleration dωbr, the target speed is also permitted to be fixed a predetermined one. For example, in a type of crane automatically performing a lowering operation on the basis of a predetermined target speed according to an operation applied to a lowering command switch by an operator, the necessary braking capacity can be calculated on the basis of the target speed.

C) Regarding Regenerative-Power Generation Unit

The regenerative-power generation unit according to the present invention can be modified to include an exclusive generator for generating regenerative power. For example, it is also possible to connect a generator excusive for regeneration to the electric winch separately from the generator for driving the electric winch.

As described above, provided is an apparatus for braking an electric winch provided in a construction machine and driven to move a load, the apparatus being capable of brake the electric winch safely and surely with a sufficient braking force while generating regenerative power as much as possible. The apparatus includes: a regenerative-power generation unit that performs a regenerative action of generating regenerative power while applying a braking force to the electric winch; a regenerative-power receiving unit that receives the regenerative power generated by the regenerative-power generation unit; a braking device that applies a mechanical braking force to the electric winch separately from the braking force applied to the electric winch from the regenerative-power generation unit, the mechanical braking force being adjustable; and a braking control unit that provides commands to the regenerative-power generation unit and the braking device to thereby control braking of the electric winch. The braking control unit includes: a necessary-braking-capacity calculation section that calculates, on the basis of an operation state of the electric winch, a braking capacity necessary for achieving a required braking action on the electric winch; a regeneration-capacity calculation section that calculates a regeneration capacity that is a limit of a regenerative action performed by the regenerative-power generation unit and the regenerative-power receiving unit; and a command section that commands the regenerative-power generation unit and the braking device on the basis of the regeneration capacity calculated by the regeneration-capacity calculation section and the necessary braking capacity calculated by the necessary-braking-capacity calculation section. The command section, when the regeneration capacity is equal to or greater than the necessary braking capacity, commands the regenerative-power generation unit to perform the braking of the electric winch with only a regenerative action by the regenerative-power generation unit while not operating the braking device. The command section, when the regeneration capacity is less than the necessary braking capacity, commands the regenerative-power generation unit to perform the regenerative action within a range of the regeneration capacity, calculates an auxiliary braking force equivalent to a difference between the necessary braking capacity and the regeneration capacity, and commands the braking device to perform the braking of the electric winch with the auxiliary braking force.

The apparatus is able to brake the electric winch with a braking force sufficient for achieving a braking action required for the electric winch, while making full use of the regeneration capacity of the regenerative-power generation unit and the regenerative-power receiving unit to perform the generation and the reception of much regenerative power. Specifically, when the regeneration capacity is equal to or greater than the necessary braking capacity, the apparatus can perform the required braking action with only the regenerative action within the range of the regeneration capacity with no use of the braking device; on the other hand, when the regeneration capacity is less than the necessary braking capacity, the apparatus can surely brake the electric winch while making full use of the regeneration capacity, by bringing the braking device into braking action as a supplement to the regeneration capacity (that is, with an auxiliary braking force equivalent to the difference between the capacities).

The regeneration-capacity calculation section desirably calculates the regeneration capacity on the basis of at least one of a regenerative-power generation capacity of the regenerative-power generation unit and a regenerative-power receiving capacity of the regenerative-power receiving unit. Furthermore, the regeneration-capacity calculation section, if calculating the regeneration capacity on the basis of selection of the lower one of the regenerative-power generation capacity and the regenerative-power receiving capacity, can safely operate both of the regenerative-power generation unit and the regenerative-power receiving unit even when both of the regenerative-power generation capacity and the regenerative-power receiving capacity are restricted.

The regeneration-capacity calculation section desirably calculates, as the regeneration capacity, at least one of an allowable value of the regenerative power generated and received by the regenerative-power generation unit and the regenerative-power receiving unit and an allowable value of the regenerative energy generated and received by the regenerative-power generation unit and the regenerative-power receiving unit. Furthermore, in the case where the regeneration-capacity calculation section is configured to calculate both of the allowable value of the regenerative power and the allowable value of the regenerative energy, the command section can set the braking force necessary for the required braking action more properly by selecting, as a final auxiliary braking force, the greater one between a first auxiliary braking force calculated by comparing the necessary braking capacity and the allowable value of the regenerative power and a second auxiliary braking force calculated by comparing the necessary braking capacity and the allowable value of the regenerative energy.

For example, the necessary-braking-capacity calculation section desirably calculates braking energy necessary for performing the required braking action, on the basis of load torque applied to the electric winch by the load, and calculates the necessary braking capacity on the basis of the braking energy.

Furthermore, in the case where the construction machine is a crane and the electric winch is mounted on the crane in order to lift and lower a suspended load which is the load, the necessary-braking-capacity calculation section can calculate the load torque on the basis of a lifting load due to the suspended load. If the crane includes an overload protection device, it allows the necessary-braking-capacity calculation section to calculate the load torque on the basis of the lifting load output by the overload protection device. Alternatively, the necessary-braking-capacity calculation section can be modified to calculate the lifting load on the basis of output torque of an electric motor driving the electric winch and to calculate the load torque on the basis of the lifting load.

The braking apparatus according to the present invention may further include an operation device that receives an operation for designating a target speed as to a speed of the electric winch adjusted by the braking and inputs a command of the target speed corresponding to the operation into the braking control unit. It is desirable, in this case, that the necessary-braking-capacity calculation section captures, on a real time basis, the target speed designated by the operation device, calculates deceleration necessary for the braking action on the basis of a difference between the target speed and actual speed of the electric winch, and calculates the necessary braking capacity on the basis of the deceleration. This allows a desirable braking control in consideration with the demand of the operator on a real time basis to be performed.

The regenerative-power generation unit, although being permitted to include an exclusive generator for generating regenerative power, suitably includes an electric motor capable of both of a motor action of driving the electric winch and a generator action of generating the regenerative power and a motor control circuit that is provided with a command by the braking control unit to bring the electric motor into the generator action.

The regenerative-power receiving unit, although being permitted to be one converting generated regenerative power into kinetic energy or thermal energy, desirably includes an electric storage device that stores the regenerative power. The electric storage device, storing the generated regenerative power, enables the regenerative power to be consumed at a suitable point in time when it is required.

This application is based on Japanese Patent application No. 2015-174607 filed in Japan Patent Office on Sep. 4, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An apparatus for braking an electric winch provided in a construction machine and driven to move a load, the apparatus comprising:

a regenerative-power generation unit that performs a regenerative action of generating regenerative power while applying a braking force to the electric winch;

a regenerative-power receiving unit that receives the regenerative power generated by the regenerative-power generation unit;

a braking device that applies a mechanical braking force to the electric winch separately from the braking force applied to the electric winch from the regenerative-power generation unit, the mechanical braking force being adjustable; and a braking control unit that provides commands to the regenerative-power generation unit and the braking device to thereby control braking of the electric winch, wherein:

the braking control unit includes a necessary-braking-capacity calculation section that calculates, on the basis of an operation state of the electric winch, a braking capacity necessary for achieving a required braking action on the electric winch, a regeneration-capacity calculation section that calculates a regeneration capacity that is a limit of a regenerative action performed by the regenerative-power generation unit and the regenerative-power receiving unit, and a command section that commands the regenerative-power generation unit and the braking device on the basis of the regeneration capacity calculated by the regeneration-capacity calculation section and the necessary braking capacity calculated by the necessary-braking-capacity calculation section;

the command section, when the regeneration capacity is equal to or greater than the necessary braking capacity, commands the regenerative-power generation unit to perform the braking of the electric winch with only a regenerative action by the regenerative-power generation unit while not operating the braking device; and the command section, when the regeneration capacity is less than the necessary braking capacity, commands the regenerative-power generation unit to perform the regenerative action within a range of the regeneration capacity, calculates an auxiliary braking force equivalent to a difference between the necessary braking capacity and the regeneration capacity, and commands the braking device to perform the braking of the electric winch with the auxiliary braking force.

2. The braking apparatus for an electric winch according to claim 1, wherein the regeneration-capacity calculation section calculates the regeneration capacity on the basis of at least one of a regenerative-power generation capacity of the regenerative-power generation unit and a regenerative-power receiving capacity of the regenerative-power receiving unit.

3. The braking apparatus for an electric winch according to claim 2, wherein the regeneration-capacity calculation section calculates the regeneration capacity on the basis of selection of a lower capacity between the regenerative-power generation capacity and the regenerative-power receiving capacity.

4. The braking apparatus for an electric winch according to claim 1, wherein the regeneration-capacity calculation section calculates, as the regeneration capacity, at least one of an allowable value of the regenerative power generated and received by the regenerative-power generation unit and the regenerative-power receiving unit and an allowable value of regenerative energy generated and received by the regenerative-power generation unit and the regenerative-power receiving unit.

5. The braking apparatus for an electric winch according to claim 4, wherein the regeneration-capacity calculation section calculates both of the allowable value of the regenerative power and the allowable value of the regenerative energy, and the command section selects, as a final auxiliary braking force, a greater one between a first auxiliary braking force calculated by comparing the necessary braking capacity and the allowable value of the regenerative power and a second auxiliary braking force calculated by comparing the necessary braking capacity and the allowable value of the regenerative energy.

6. The braking apparatus for an electric winch according to claim 1, wherein the necessary-braking-capacity calculation section calculates, on the basis of load torque applied to the electric winch by the load, braking energy necessary for performing the required braking action and calculates the necessary braking capacity on the basis of the braking energy.

7. The braking apparatus for an electric winch according to claim 6, wherein the construction machine is a crane and the electric winch is mounted on the crane in order to lift and lower a suspended load which is the load, and wherein the necessary-braking-capacity calculation section calculates the load torque on the basis of a lifting load due to the suspended load.

8. The braking apparatus for an electric winch according to claim 7, wherein the crane includes an overload protection device, and the necessary-braking-capacity calculation section calculates the load torque on the basis of the lifting load output by the overload protection device.

9. The braking apparatus for an electric winch according to claim 7, wherein the necessary-braking-capacity calculation section calculates the lifting load on the basis of output torque of an electric motor driving the electric winch, and calculates the load torque on the basis of the lifting load.

10. The braking apparatus for an electric winch according to claim 1, further comprising an operation device that receives an operation for designating a target speed as to a speed of the electric winch adjusted by the braking and inputs a command of the target speed corresponding to the operation to the braking control unit, wherein the necessary-braking-capacity calculation section captures, on a real time basis, the target speed designated by the operation device, calculates deceleration necessary for the braking action on the basis of a difference between the target speed and actual speed of the electric winch, and calculates the necessary braking capacity on the basis of the deceleration.

11. The braking apparatus for an electric winch according to claim 1, wherein the regenerative-power generation unit includes an electric motor capable of both of a motor action for driving the electric winch and a generator action for generating the regenerative power and a motor control circuit that is provided with a command by the braking control unit to bring the electric motor into the generator action.

12. The braking apparatus for an electric winch according to claim 1, wherein the regenerative-power receiving unit includes an electric storage device that stores the regenerative power generated by the regenerative-power generation unit.

* * * * *